US006078034A

United States Patent [19]

Le Van Suu

[11] Patent Number: 6,078,034

[45] Date of Patent: Jun. 20, 2000

[54] METHOD FOR CONTROLLING POWER OF AN ELECTRONIC OVEN AND ASSOCIATED DEVICE

[75] Inventor: Maurice Le Van Suu, Savigny le Temple, France

[73] Assignee: Stmicroelectronics S.A., Gentilly, France

[21] Appl. No.: 09/234,083

[22] Filed: Jan. 19, 1999

[30] Foreign Application Priority Data

Jan. 22, 1998 [FR] France ..... 98 00673

[51] Int. Cl.[7] ..... H05B 6/50

[52] U.S. Cl. ..... 219/705; 219/707

[58] Field of Search ..... 219/705, 704, 219/710, 716, 681, 757, 400, 707

[56] References Cited

U.S. PATENT DOCUMENTS

| | | | |
|---|---|---|---|
| 4,162,381 | 7/1979 | Buck | 219/705 |
| 4,281,022 | 7/1981 | Buck | 426/233 |
| 4,335,293 | 6/1982 | Kobayashi et al. | 219/707 |
| 5,396,715 | 3/1995 | Smith | 34/261 |
| 5,483,044 | 1/1996 | Thorneywork et al. | 219/681 |
| 5,552,584 | 9/1996 | Idebro | 219/707 |
| 5,873,258 | 2/1999 | Pfister et al. | 62/331 |
| 5,905,648 | 5/1999 | Badami | 364/148.1 |
| 5,920,477 | 7/1999 | Hoffberg et al. | 364/188 |

FOREIGN PATENT DOCUMENTS

| | | | |
|---|---|---|---|
| 0 000 957 | 3/1979 | European Pat. Off. | G05D 22/02 |
| 0 491 619 | 6/1992 | European Pat. Off. | H05B 6/68 |
| 0 493 266 | 7/1992 | European Pat. Off. | H05B 6/68 |
| 0 517 433 | 12/1992 | European Pat. Off. | F24C 7/08 |
| 0 579 917 | 1/1994 | European Pat. Off. | H05B 6/68 |
| 0 688 146 | 12/1995 | European Pat. Off. | H05B 6/68 |
| 0 688 149 | 12/1995 | European Pat. Off. | H05B 6/68 |
| 0 701 387 | 3/1996 | European Pat. Off. | H05B 6/68 |

*Primary Examiner*—Teresa Walberg
*Assistant Examiner*—Jeffrey Pwu
*Attorney, Agent, or Firm*—Theodore E. Galanthay; Allen, Dyer, Doppelt, Milbrath & Gilchrist, P.A.

[57] ABSTRACT

The method is for the control of an electrical oven and includes taking into account the temperature and/or the humidity level of the air measured by sensors in the interior of a cavity of an oven in which food to be heated and/or cooked is placed. The instantaneous value of the supplied power of the magnetron of the oven and the duration of a heating cycle are controlled, such as by fuzzy logic.

27 Claims, 2 Drawing Sheets

R10: IF P = NORMAL AND IF T = VERY SMALL AND IF H = SMALL THEN P = GREAT

⋮ ⋮ ⋮ ⋮

R20: IF P = NORMAL AND IF T = NORMAL AND IF H = GREAT THEN P = GREAT

⋮ ⋮ ⋮ ⋮

R30: IF T = VERY GREAT AND IF H = VERY GREAT THEN P = 0

⋮ ⋮ ⋮

FIG. 4.

METHOD FOR CONTROLLING POWER OF AN ELECTRONIC OVEN AND ASSOCIATED DEVICE

FIELD OF THE INVENTION

The present invention relates to control methods, and, more particularly, to a method and apparatus for the control of an electrical oven.

BACKGROUND OF THE INVENTION

Microwave ovens use the principle of the excitation of molecules to prompt the heating and cooking of food. To this end, the food is placed within a cavity of the oven forming a Faraday cage in which radiation of waves at very high frequency is produced by a transducer called a magnetron. A part of the electrical power consumed by the magnetron and by its supplying device is transferred to the food in the form of heat.

The energy balance of this reaction is complex, accordingly, it will simply be noted that, for a given value of supplied power of the magnetron, the time needed to bring food to a given temperature is a function of various parameters. Hereinafter, an operating cycle of the oven to bring food to its ideal temperature of consumption is called a "heating cycle". The duration of a heating cycle depends, for example, on the nature of the food (liquid, meat, vegetables, etc.), the volume of the sample to be heated, its density, its initial temperature, etc.

In the prior art (FIG. 1), the user programs the duration of a heating cycle by a timer or similar programming device that is accessible on the control panel 2 of the oven 1. This is done after placing the food to be heated inside the oven and closing its door 3. To carry out this programming operation, the user must estimate the appropriate duration of the heating cycle on the basis of an assessment of the above-mentioned parameters and of his own experience in the use of the oven.

This estimate is, by its nature, highly approximative. This is why it is not unusual for the duration of the heating cycle programmed by the user to be actually far too short or far too long. In the former case, a new heating cycle has to be programmed. In the latter case, there may be phenomena of boiling in the food that get splashed about and thus ruined. The user is therefore often forced to look through the window of the oven door to see how the appearance of the food is progressing in the course of the heating cycle so that, if necessary, he can stop the cycle before it ends.

In certain cases, the control panel 2 of the oven 1 furthermore has keys or pushbuttons by which the user can program different values of the operating power of the oven, namely the values of the supplied power of the magnetron. The user must also make a choice, for example, between a key corresponding to non-frozen solid food, a key corresponding to liquids, and a key corresponding to frozen food ("defrost" or "thaw" key), identified by appropriate symbols. These three keys correspond, for example, to instantaneous values of the supplied power of the magnetron. These values may be equal, respectively, to 300 watts, 500 watts and 1000 watts.

However, far from eliminating the above-mentioned problems entailed by having the user program the duration of the heating cycle in an approximate fashion, this additional user choice has a consequence of introducing an additional degree of arbitrariness into the programming. Accordingly, there is an even greater risk of an unsuitable duration being programmed.

Furthermore, the plurality of programming parameters (operating power and duration of the heating cycle) give a more random character to the interpretation and storage of the results of successive programming operations. The user therefore has greater difficulty in using his experience of the oven.

SUMMARY OF THE INVENTION

An object of the present invention is to mitigate the above-mentioned drawbacks caused by the control systems of prior art ovens.

To this end, the invention includes a method for the control of an electrical oven for the heating and/or cooking of food, the oven comprising a cavity within which the foodstuffs may be placed. The method comprises the following steps:

- the supply of electrical power to the oven according to a first instantaneous value of power;
- the measurement of the temperature and/or the humidity level of the air within the cavity;
- if necessary, the adaptation of the instantaneous value of the supplied power as a function of this measurement; and
- the stopping of the supply of power to the oven when the temperature and/or humidity level of the air within the cavity substantially have respective values indicating that the food has been appropriately heated.

The air temperature within the cavity indirectly reflects the temperature of the food. Since almost all food has a high water content, it has been observed that, when the food is heated, its temperature rises and a part of the water that it contains may evaporate. Since the food is placed in the cavity of the oven which is substantially hermetically sealed, the humidity level within this cavity increases.

It is after the observation of this evaporative effect that the method of the invention as defined here above has been conceived. The intention includes taking into account the humidity level and/or also the temperature of the air within the cavity of the oven. Preferably, the method is implemented by a fuzzy logic algorithm.

Preferably, these two variables are taken into account simultaneously for their combination enables the thermal behavior of the food during the heating cycle to be reflected more efficiently. However, it is also possible to take into account only one of these variables.

Thus, the instantaneous value of the supplied power of the oven (namely the magnetron) and the duration of a heating cycle are controlled automatically, that is, without any action by the user. The operation of the oven stops automatically when the food is hot.

The invention also relates to a device for the implementation of the above method. A device of this kind comprises:

- means delivering a signal of measurement of the air temperature inside the cavity;
- means to deliver a signal of measurement of the humidity level of the air inside the cavity; and
- a fuzzy logic management unit accepting the measurement signals as input variables and producing, as an output variable, a value that is the instantaneous value of the supplied power of the oven.

Finally, the invention relates to an electrical oven, especially a microwave oven, for the heating and/or cooking of food comprising a control device, such as, the one described above.

The invention is particularly suited to the control of electrical microwave ovens inasmuch as, for this type of oven, the rise in temperature and in the level of humidity of the air within the cavity is a consequence of the electrical power of the oven. This power is applied rapidly and can be taken into account to adapt the instantaneous value of the supplied power of the oven with a rapid effect.

Furthermore, since the behavior of the food during the heating cycle is, as we have seen, difficult to model without taking account of numerous parameters (such as type, volume, density, initial temperature of food, etc.) which furthermore are difficult to measure, a fuzzy logic algorithm is advantageously used to drive the device of the invention.

BRIEF DESCRIPTION OF THE DRAWINGS

Other features and advantages of the present invention shall appear from the following description. This description is given purely by way of an illustration and must be read with reference to the appended drawings, of which:

FIG. 4 shows a table of rules of coherence implemented by a fuzzy logic algorithm according to the invention.

DETAILED DESCRIPTION OF THE PREFERRED EMBODIMENTS

Figure 1:
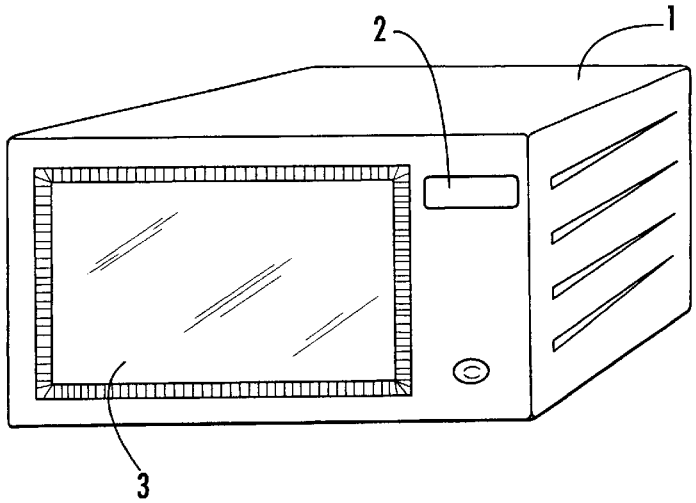
FIG. 1. PRIOR ART
FIG. 1, which has already been analyzed, shows a microwave oven according to the prior art.
Figure 2:
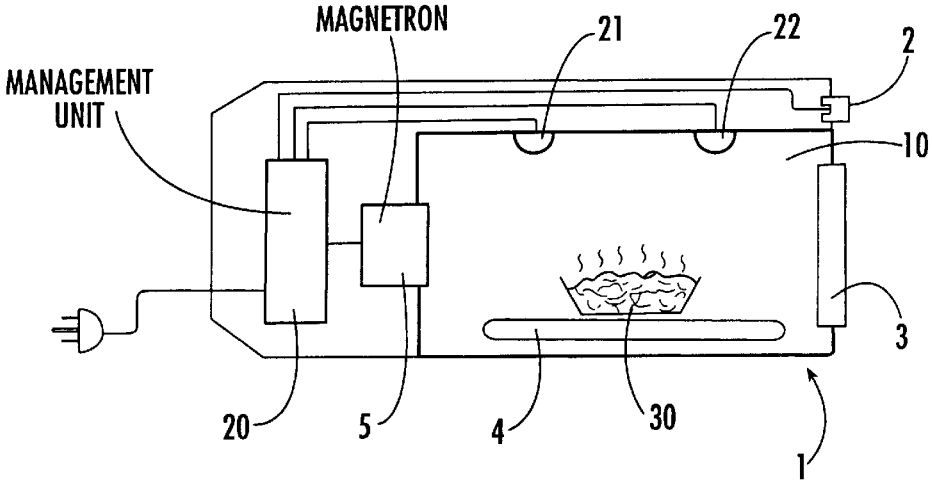
FIG. 2 shows a sectional view of a microwave oven providing a diagrammatic view of the invention.

FIG. 2, in which the same elements as in FIG. 1 bear the same references, gives a sectional view of a microwave oven showing the control device according to the invention. The oven 1 has a cavity 10 hermetically sealed by the door 3. Food 30 to be heated or cooked, contained in a receptacle, may be placed inside the cavity 10. The food 30 may be positioned on a tray 4 that may be fixed or rotating.

Radiation of waves at very high frequency can be produced inside the cavity 10 by a magnetron 5. This magnetron is, for example, positioned on a vertical wall of the cavity 10 opposite the door 3. The magnetron 5 receives electrical power delivered by a management unit 20. The management unit 20 receives a supply voltage such as the AC voltage from the main supply (220 volts; 50 Hz).

The device also includes means delivering a signal of measurement of the air temperature inside the cavity 10. These means comprise a temperature sensor 21 positioned, for example, on the upper wall of the cavity 10.

The device includes means to measure the humidity level inside the cavity 10. These means include a humidity sensor 22 positioned, for example, on the upper wall of the cavity 10. The term "humidity level" is understood here to mean the hygrometric readings within the hermetically sealed cavity 10.

The management unit 20 is a fuzzy logic management unit. It comprises a fuzzy logic microcontroller, such as, for example, the WARP 3 microcontroller marketed by SGS-THOMSON MICROELECTRONICS. The management unit 20 accepts the temperature measurement signal and the humidity level measurement signal for the air within the cavity as input variables, T and H respectively. These are variables know as "fuzzy variables". The management unit 20 produces an output variable P which is a value corresponding to the instantaneous value of the supplied power of the oven, and, more specifically, the magnetron 5.

Other input variables may also be taken into account in the fuzzy logic algorithm which drives the management unit 20 to take into account other parameters. Another parameter of this kind is, for example, the air pressure within the cavity 10. The oven control device then comprises a pressure sensor positioned like the sensors 21 and 22 and delivering a signal to measure the air pressure inside the cavity 10.

For each of the input variables T and H, and for the output variable P, a specified number of membership functions are defined in a memory of the microcontroller. In one example, for each variable, there are five membership functions available. This number is sufficient to enable efficient management of the electrical power of the oven, and without requiring any excessive storage capacity within the microcontroller or an excessively complex fuzzy logic algorithm (and hence excessive processing time).

Figure 3:
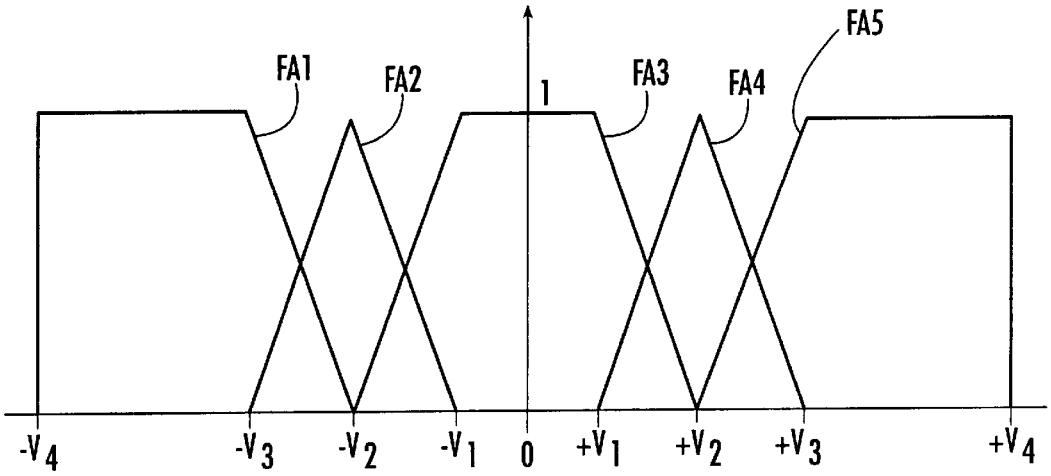
FIG. 3 gives an example of the form of the membership functions of the fuzzy logic variables implemented by a fuzzy logic algorithm according to the invention.

FIG. 3 shows a possible form of the five membership functions FA1 to FA5 covering the totality of the dynamic range of the variables considered. It is recalled that the membership functions FA1 to FA5 define, for the fuzzy variable considered, the value of a coefficient characterizing the likelihood of the membership of this variable in a set of values. The set of values (called a "fuzzy set") is defined approximately by a fuzzy value of the type "VERY SMALL", "SMALL", "NORMAL", "GREAT" and "VERY GREAT" respectively.

In FIG. 3, the dynamic range of variation has been centered on the mean value of the variable. In the figure, the mean value coincides with the starting point of the axes. Furthermore, the value of the likelihood coefficient has been normalized to 1. For each variable, the following are thus counted:

- a first membership function FA1 which defines a set of values for which the variable is assigned the fuzzy value "VERY SMALL"; this function is flat and is equal to unity between the value −V4 and the value −V3 and then decreases linearly from this value and gets cancelled out at the value −V2;
- a second membership function FA2 that defines a set of values for which the variable is assigned the fuzzy value "SMALL"; this function increases linearly from 0 onwards to the value −V3 and reaches unity at the value −V2, beyond which it decreases linearly to get cancelled out again at the value −V1;
- a third membership function FA3 that defines a set of values for which the variable is assigned the fuzzy value "NORMAL"; this function increases linearly from 0 onwards to the value −V2 and reaches unity at the value −V1; it is then constant and equal to unity between the value −V1 and the symmetrical value +V1 beyond which it decreases linearly and gets cancelled out again at the value +V2;
- a fourth membership function FA4 that defines a set of value for which the variable is assigned the fuzzy value "GREAT"; this function increases linearly from 0 onwards to the value +V1 and reaches unity at the value +V2 beyond which it decreases linearly and gets cancelled out again at the value +V3; and
- finally, a fifth membership function FA5 that defines a set of values for which the variable is assigned the fuzzy value "VERY GREAT"; this function increases linearly from 0 onwards to the value +V2 and reaches unity at the value +V3, beyond which it remains constant.

As we have understood, the functions FA5 and FA4 are symmetrical with the functions FA1 and FA2 respectively, with respect to the Y axis. The function FA3 is itself symmetrical with respect to this axis. However, this is only one example and it is clear that the membership functions may have any shape. In particular, it is known that Gaussian curves (bell-shaped curves) may give a better definition of the fuzzy sets than a curve comprising straight line segments (jagged-line curves).

The advantage of the shape of the membership functions shown in FIG. 3 lies in that these functions can be stored in the memory of the microcontroller solely by the storage of the noted values V1, V2, V3 and V4 defining the limits of the fuzzy sets. This, therefore, requires a relatively small memory space.

Furthermore, for each variable of the physical system, these noteworthy values of the membership functions can easily be determined by automatic generation software, such as, the fuzzy logic systems development tool by SGS-THOMSON MICROELECTRONICS under the name "AFM & FUZZYSTUDIO".

The management unit 20 implements a fuzzy logic algorithm. As is known to those skilled in the art, an algorithm of this kind is based on the verification of a certain number of rules, called "coherence rules", that link the variable output to one or more input variables. Each rule establishes a decision concerning the fuzzy value of the output variable on the basis of the fuzzy value of one or more of the input variables with a logic syntax of the following type:

IF <E1> AND IF <E2> THEN <E3> where E1 and E2 are expressions noting, as the case may be, that an input variable has a given fuzzy value, for example, SMALL and GREAT; and where E3 is an expression giving the output variable a certain fuzzy logic value.

In the algorithm, the n rules of coherence are successively verified with the fuzzy values of the input variables and their associated likelihood coefficient. This is done to deduce n fuzzy values of the output variable with a likelihood coefficient for each value. This likelihood coefficient may be the arithmetic mean or the minimum of the above-mentioned likelihood coefficients (depending on whether the method used is the one known as the mean method or the one known as the minimum method). Finally, the digital value of the output variable is determined as the sum of the digital values corresponding to one of the n fuzzy values weighted by the likelihood coefficient that are associated with them. As it happens, this digital value is an instructed value of the electrical supply power delivered to the magnetron.

With two input variables and one output variable for each of which five membership functions (five fuzzy sets of values) are defined, it is theoretically possible to write one hundred and twenty-five different rules of coherence. The probability that certain rules will be verified is so small that they need not be taken into account. This makes it possible correspondingly to lighten the burden on the memory of the controller in which the rules are saved. Furthermore, since the number of computations to be performed is thus reduced, the running of the fuzzy logic algorithm is faster. FIG. 4 shows a table containing certain rules of coherence implemented in the fuzzy logic algorithm that drives the management unit 20.

The method used to control the oven according to the invention comprises several steps. In a first step, the oven is supplied according to the first instantaneous value of supplied power. More specifically, the management unit 20 delivers a first instantaneous value of supplied power to the magnetron 5. By default, the instantaneous value of the supplied power of the magnetron is, for example, set at an initial value corresponding to a fuzzy value of the variable P equal to NORMAL.

In a second step, the temperature and/or the humidity level of the air inside the cavity 10 is measured with sensors 20 and 21, and the measurement signals produced by these sensors are transmitted to the input of the management unit 20. As the case may be, in a third step, the instantaneous value of the power supplied to the magnetron is adapted to these measurement signals.

For example, if the temperature of the air inside the oven is very low (T=VERY SMALL), then it is possible to increase the instantaneous value of the supplied power of the magnetron beyond its initial value. The set of rules of coherence implemented in the fuzzy logic algorithm comprises, to this effect, a rule such as the rule R10 that can be seen in the table of FIG. 4.

According to another example, if the humidity level of the air inside the cavity is great, while the temperature of the air therein is relatively low, then there is boiling on the surface of the food being heated. At the same time, the core of this food remains at a low temperature. It is then necessary to increase the instantaneous value of the supplied power to heat the food in depth. The phenomenon described here occurs typically in the heating of frozen foods. The set of coherence rules implemented in the fuzzy logic algorithm comprises, to this effect, a rule such as the rule R20 that can be seen in the table of FIG. 4.

Finally, in a last step, the electrical supply of the oven is stopped when the temperature and the humidity level of the air inside the cavity of the oven substantially have respective values indicating that the food has been appropriately heated. To this end, the set of rules implemented by the unit 10 comprises a rule, such as, the rule 30 of the table of FIG. 4. Furthermore, it can be planned to generate an audible signal by appropriate means to inform the user that the heating cycle is over, that is, that the food has been appropriately heated and is at its ideal temperature.

As can be seen, the definition of the rules of coherence implemented by the fuzzy logic algorithm according to the invention can be deduced from an empirical knowledge of the behavior of the food inside the oven during a heating cycle. In practice, the rules of coherence are defined on the basis of a database of behavior, a point that the designers of fuzzy logic systems are aware of.

Through the invention, the control table 2 of the oven 1 no longer has a single on/off button to activate the start of a heating cycle. In particular, there is no longer any need for timers or analog programming devices. Similarly, there is no need for a button to adjust the supplied power of the oven.

The invention has been described here above with reference to a preferred but non-restricted exemplary embodiment. It is clear that it is possible to diverge from this exemplary embodiment without departing from the framework of the invention as understood from the above description. For example, the control method and devices may be applied to ovens other than microwave ovens.

That which is claimed is:

1. A method for controlling an electrical oven comprising a cavity for containing food, the method comprising the steps of:

supplying electrical power to the oven according to a first instantaneous value of supplied power;

measuring at least one of a temperature and humidity of air within the cavity;

adapting the first instantaneous value cf supplied power responsive to the measuring step; and stopping the supply of electrical power to the oven responsive to at least one of the temperature and humidity of the air within the cavity having a value indicating that the food is appropriately heated;

at least one of the adapting and stopping steps being performed according to a fuzzy logic algorithm.

2. A method according to claim 1, wherein the step of measuring further comprises the step of measuring pressure within the cavity.

3. A method according to claim 1, wherein the step of measuring comprises measuring both temperature and humidity.

4. A method according to claim 1, wherein the oven is a microwave oven.

5. A method for controlling a microwave oven comprising a cavity for containing food and a magnetron for heating the food, the method comprising the steps of:

supplying electrical power to the magnetron according to a first instantaneous value of supplied power;

measuring both a temperature and humidity within the cavity;

adapting the first instantaneous value of supplied power responsive to the measuring step; and stopping the supply of electrical power to the oven responsive to at least one of the temperature and humidity within the cavity having a value indicating that the food is appropriately heated.

6. A method according to claim 5, wherein the step of adapting is performed according to a fuzzy logic algorithm.

7. A method according to claim 5, wherein the step of stopping is performed according to a fuzzy logic algorithm.

8. A method according to claim 5, wherein the step of measuring further comprises the step of measuring pressure within the cavity.

9. A method for controlling a microwave oven comprising a cavity for containing food and a magnetron for heating the food, the method comprising the steps of:

supplying electrical power to the magnetron according to a first instantaneous value of supplied power;

measuring at least one of a temperature and humidity within the cavity;

adapting the first instantaneous value of supplied power responsive to the measuring step; and stopping of the supply of electrical power to the oven responsive to at least one of the temperature and humidity within the cavity having a value indicating that the food is appropriately heated;

at least one of the adapting and stopping steps being performed according to a fuzzy logic algorithm.

10. A method according to claim 5, wherein the step of measuring further comprises the step of measuring pressure within the cavity.

11. An electrical oven comprising:

a plurality of walls defining a cavity for receiving food therein;

an electrical heater for heating food within the cavity;

a temperature sensor for sensing temperature within the cavity;

a humidity sensor for sensing humidity within the cavity; and a fuzzy logic management unit for controlling an instantaneous value of the electrical heater responsive to said temperature and humidity sensors.

12. An electrical oven according to claim 11, wherein said electrical heater comprises a magnetron.

13. An electrical oven according to claim 11, wherein said fuzzy logic management unit uses a fuzzy logic algorithm including a set of rules of coherence for stopping said electrical heater responsive to the sensed temperature and humidity have reached values substantially indicating that the food has been appropriately heated.

14. An electrical oven according to claim 11, further comprising a pressure sensor connected to said fuzzy logic management unit.

15. A microwave oven comprising:

a plurality of walls defining a cavity for receiving food therein;

an magnetron for heating food within the cavity;

at least one of a temperature sensor and a humidity sensor associated with the cavity; and a fuzzy logic management unit for controlling an instantaneous value of the magnetron responsive to at least one of said temperature and humidity sensors.

16. A microwave oven according to claim 15, wherein said fuzzy logic management unit uses a fuzzy logic algorithm including a set of rules of coherence for stopping said magnetron responsive to the sensed temperature and humidity have reached values substantially indicating that the food has been appropriately heated.

17. A microwave oven according to claim 15, further comprising a pressure sensor connected to said fuzzy logic management unit.

18. A method according to claim 1, wherein the step of measuring provides at least one of a measured temperature value and a measured humidity value as an input variable to the fuzzy logic algorithm.

19. A method according to claim 1, wherein an output variable of the fuzzy logic algorithm corresponds to the first instantaneous value of the supplied power.

20. A method according to claim 5, wherein the step of measuring provides at least one of a measured temperature value and a measured humidity value as an input variable to the fuzzy logic algorithm.

21. A method according to claim 5, wherein an output variable of the fuzzy logic algorithm corresponds to the first instantaneous value of the supplied power.

22. A method according to claim 9, wherein the step of measuring provides at least one of a measured temperature value and a measured humidity value as an input variable to the fuzzy logic algorithm.

23. A method according to claim 9, wherein an output variable of the fuzzy logic algorithm corresponds to the first instantaneous value of the supplied power.

24. An electrical oven according to claim 11, wherein sensed temperature and humidity values are provided as input variables to said fuzzy logic management unit.

25. An electrical oven according to claim 11, wherein said fuzzy logic management unit provides an output variable corresponding to the instantaneous value of the supplied power.

26. A microwave oven according to claim 15, wherein sensed temperature and humidity values are provided as input variables to said fuzzy logic management unit.

27. A microwave oven according to claim 15, wherein said fuzzy logic management unit provides an output variable corresponding to the instantaneous value of the supplied power.

* * * * *